US007786414B2

(12) United States Patent
Schilling et al.

(10) Patent No.: US 7,786,414 B2
(45) Date of Patent: Aug. 31, 2010

(54) INDUCTION HEATING DEVICE AND HOB HAVING SUCH AN INDUCTION HEATING DEVICE

(75) Inventors: Wilfried Schilling, Kraichtal (DE); Ralf Dorwarth, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 11/828,751

(22) Filed: Jul. 26, 2007

(65) Prior Publication Data

US 2007/0278215 A1 Dec. 6, 2007

Related U.S. Application Data

(63) Continuation of application No. PCT/EP2006/000619, filed on Jan. 25, 2006.

(30) Foreign Application Priority Data

Jan. 31, 2005 (DE) ..... 10 2005 005 527

(51) Int. Cl.
*H05B 6/12* (2006.01)
*F24C 15/20* (2006.01)

(52) U.S. Cl. ..... 219/623; 219/622; 126/299 D

(58) Field of Classification Search ..... 219/620–627, 219/632, 663, 667, 676, 677; 99/451, 325, 99/DIG. 14
See application file for complete search history.

(56) References Cited

U.S. PATENT DOCUMENTS 4,348,571 A 9/1982 Dills
4,490,596 A 12/1984 Hirai et al.
4,511,781 A * 4/1985 Tucker et al. ..... 219/626
4,549,052 A 10/1985 Simon
4,551,600 A 11/1985 Miyagawa et al.
4,665,893 A 5/1987 Miyagawa et al.
5,019,682 A * 5/1991 Lee ..... 219/623
5,428,207 A 6/1995 Essig et al.

(Continued)

FOREIGN PATENT DOCUMENTS

DE 36 31 964 A1 3/1987

(Continued)

OTHER PUBLICATIONS

International Search Report from PCT/EP2006/000619, dated May 3, 2006.

(Continued)

*Primary Examiner*—Quang T Van
(74) *Attorney, Agent, or Firm*—Alston & Bird LLP

(57) ABSTRACT

An induction heating device for a glass ceramic hob or cooktop is embodied as an autonomous component. Said induction heating device comprises a bearing device which, in addition to the induction coil, supports a component support comprising power electronics and control electronics. Only the control connections for the control signals in relation to the power of a line and a direct connection to the household power are provided on said induction heating device. The control electronics ensure the power of a line to the power electronics. Advantageously, said induction heating devices have external dimensions which are the same as traditional radiant heating bodies and thus can easily be used in lieu of said traditional radiant heating bodies when constructing said hob.

28 Claims, 7 Drawing Sheets

U.S. PATENT DOCUMENTS

| | | | | |
|---|---|---|---|---|
| 5,488,214 | A | 1/1996 | Fettig et al. | |
| 6,498,325 | B1 * | 12/2002 | Akel et al. | 219/624 |
| 7,135,661 | B2 * | 11/2006 | Park et al. | 219/623 |

FOREIGN PATENT DOCUMENTS

| | | | | |
|---|---|---|---|---|
| DE | 202 04 249 | U1 | 5/2002 | |
| DE | 101 63 839 | A1 | 7/2003 | |
| EP | 0 722 261 | A1 | 7/1996 | |
| EP | 1 463 383 | A1 | 9/2004 | |
| JP | 4-245188 | * | 9/1992 | 219/623 |
| JP | 5-29073 | | 2/1993 | |

OTHER PUBLICATIONS

German Search Report for German Application No. 102005005527.3.

* cited by examiner

INDUCTION HEATING DEVICE AND HOB HAVING SUCH AN INDUCTION HEATING DEVICE

CROSS REFERENCE TO RELATED APPLICATIONS

This application is a continuation of PCT/EP2006/000619, filed Jan. 25, 2006, which is based on German Application No. 10 2005 005 527.3, filed Jan. 31, 2005, of which the contents of both are hereby incorporated by reference.

FIELD OF APPLICATION

The invention generally relates to an induction heating device for a hotplate, as well as a hob having such an induction heating device.

BACKGROUND

The construction of a hob (cook top) with induction heating devices is known, for example, from DE 198 17 197 A1, where individual induction coils, in certain circumstances wound onto their own supports, are located in a receiving tray of an induction hob. They are connected to a central power supply, which is provided either for all the induction heating devices or for at least two induction heating devices. Corresponding to the preset power stage, a hob control emits signals to the power supply for supplying corresponding power to the particular induction heating device.

It is also known from DE 199 35 835 A1 to inductively heat two hotplates on a hob using induction heating devices and to heat the other hotplates with radiant heaters. A common power supply is provided for powering both induction heating devices and which, corresponding to the control instructions, supplies power to one or both of the induction heating devices. In particular, the two induction heating devices can be constructed as an associated, so-called 'twin module.'

One problem solved by the invention is to provide an aforementioned induction heating device and a hob equipped therewith, making it possible to obviate the problems of the prior art and in particular permitting a desired construction of a hob in numerous different ways.

BRIEF DESCRIPTION OF THE DRAWINGS

Embodiments of the invention are described in greater detail hereinafter relative to the attached drawings, wherein:

FIGS. 1*a* and 1*b* illustrate the components of an induction heating device in the installed state, wherein FIG. 1*a* illustrates the components in an exploded form and FIG. 1*b* illustrates the components in an assembled form.

FIGS. 2*a* and 2*b* illustrate another embodiment of the induction heating device of FIG. 1, wherein FIG. 2*a* illustrates the components in an exploded form and FIG. 2*b* illustrates the components in an assembled form.

FIGS. 3*a* and 3*b* illustrate another embodiment of the induction heating device of FIG. 1, wherein FIG. 3*a* illustrates the components in an exploded form and FIG. 3*b* illustrates the components in an assembled form.

DETAILED DESCRIPTION OF THE PREFERRED EMBODIMENTS

Figure 1A:
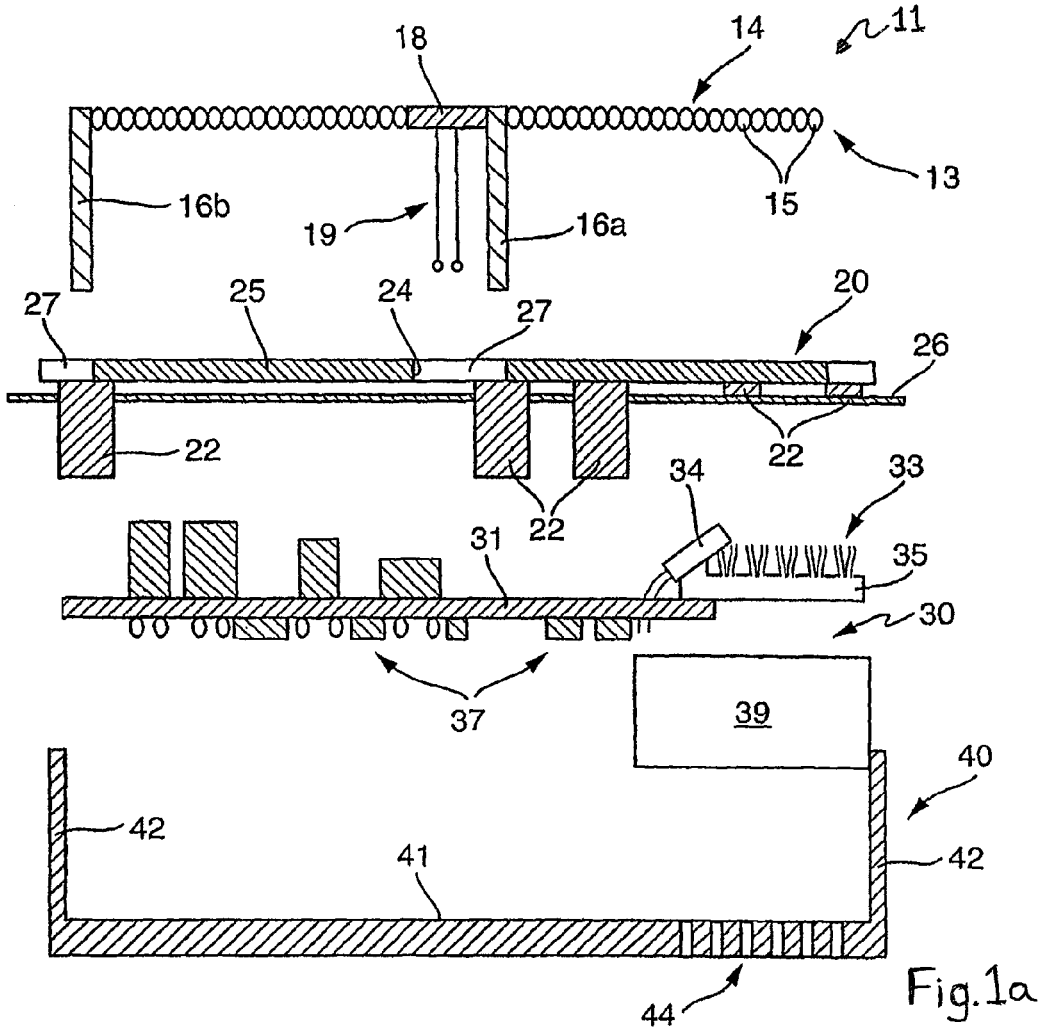

The aforementioned problems are solved in one embodiment by an induction heating device having the features of claim 1 and a hob having the features of claim 30. Advantageous and preferred developments of the invention form the subject matter of further claims and are explained in greater detail hereinafter. By express reference the wording of the claims is made into part of the content of the description.

According to one embodiment of the invention, the induction coil is placed or fixed to a support device, which can also take place in that a coil wire is wound onto said support device. On the support device is provided a supply part, which converts the supplied voltage, particularly single phase mains voltage (e.g., line voltage), for a power control for the induction coil. For this purpose, the supply part has power electronics and control electronics and for this the induction heating device has electrical power connections and electrical control connections. A fan device is also provided, which cools the power part and supplies cooling air. Finally the induction heating device is constructed as a "ready to install" or "ready to connect" module. This means that it is prefabricated to such an extent that it only has to be inserted in a hob during the assembly thereof and electrically connected. Advantageously no further steps are needed.

Thus, the invention makes it possible to rapidly and simply assemble a hob with at least one such induction heating device. In addition, the induction heating device is an autonomous functional unit, which in similar manner, as for example radiant heaters, can be very easily connected and requires no additional power electronics. Thus, in a so-called "quad hob", four separate heating devices can be introduced, whereof any number can be formed by inventive induction heating devices. The actual number of inductive heating devices in the hob plays no essential part with regards to the construction of the hob, because compared with known induction hobs there is no separate power supply or power electronics. This also has the advantage that the space is made available that otherwise is needed for the central or joint power supply. This, in turn, increases the design scope for the arrangement of the heating devices on the hob. This also makes it possible to inexpensively create smaller batches of, in each case, variously and differently arranged heating devices with a combination of induction heating devices and radiant heating devices.

Advantageously, the induction coil is flat and comprises one layer of juxtaposed wound conductors, i.e., it is in a single layer form. For this purpose, the support device is also substantially flat, for example disk-like. It supports the induction coil in full-surface manner or over its entire surface, although it can have individual openings or holes.

The supply part, which can have a plurality of components, advantageously carries the same on a printed circuit board or in general terms on a component support, which advantageously runs substantially parallel to the induction coil. In particularly advantageous manner, all the electrical components of the control electronics and/or power electronics are in particular bilaterally fitted to a single component support.

The fan device can be advantageously a conventional, integrated and relatively small fan, which only has to be electrically connected. This fan can be fixed to the support device, advantageously in a direct manner using screws or click-stop devices, etc. It can also be fixed or connected directly to the component support. It can also engage on the support device by means of spacers or the like.

Advantageously, between the component support and support device are provided spacers, which ensure a precise positioning of the component support relative to the support device and therefore within the induction device. On the one hand, it is possible to carry out positioning solely via a pressed engagement from the outside. On the other hand, the component support can be mechanically secured to the support device, for example using spacers. Such a connection should be detachable, particularly for repair or replacement purposes.

It is possible to provide a cover, which covers or surrounds various components of the induction heating device and, in particular, the component support. The cover is advantageously substantially closed or circumferential, so that a largely closed module is obtained. Obviously, openings can be provided for electric cable bushings, as well as in the form of ventilation openings.

According to a first embodiment, the cover can be dish-like, i.e., having a surface from which a lateral edge projects in significant areas. It can cover both the surface of the component support and also on the side extending up to the support device. It is possible to exclusively secure the cover to the support device or to allow fastening means such as studs or screws to engage in said support device. The cover can be applied to the component support or the component support spacer. Thus, it is possible to fix the component support to the cover in such a way that the latter presses it against the support device and advantageously engages thereon via spacers.

According to another construction possibility of the invention, at least in its outer area the support device has a projecting lateral edge, which can be entirely or substantially circumferential. Thus, the support device can itself form a dish-like reception area for receiving the supply part and the fan device. These parts can be fixed in the reception area and are advantageously directly fixed to the support device. The reception area can be closed by a cover. It can be advantageous here for it to rest substantially on the projecting lateral edges of the support device and can be in the form of a flat lid. More particularly when the component support takes up most of the surface of the induction heating device, the cover engages to the minimum thereon so as not to bend it. Alternatively, a spacer can be provided in the central area of the support device and in addition to a laterally outer fastening, a central fastening or fixing of the supply part or component support can be implemented. In this area can also act covers, because their force is then passed directly to the support device by the connection via spacers. Such spacers can be integrally connected to the support device or form an integral component. Particularly when constructed as plastic parts, the spacers can project therefrom.

It is possible to construct the support device for the induction heating means from at least two support parts. One support part can be a flat support for the induction coil or can carry the latter. Another support part can carry the supply part or its component support or can be connected thereto. Advantageously, the support parts can be interconnected in a fixed manner which can also involve a releasable mechanical connection so as to offer possibilities that are advantageous for installation and repair.

A first support part can be substantially disk-like and flat. A second support part can also be in the form of a disk and, in particular, one lateral edge projects in order to form a dish-like reception space for the supply part. The lateral edge can be essentially circumferential and of the same height. In the reception space, the component support can be fixed, for example via spacers, to the second support part. The spacers can project integrally from the second support part. For closing the module or the reception space, a substantially disk-like cover can be provided, in the manner described hereinbefore.

Advantageously, a circumferential lateral edge of the module or a cover in certain areas forms the entire lateral edge and small portions with openings or recesses can be present. Through the latter, connections or the like of the supply part, can project to the outside. In particular, the opening can be used for the easy insertion of the supply part with the projecting connections. This interruption in the lateral edge can be closed or covered by a corresponding, projecting portion on the other part. It is particularly advantageous to provide such an opening on the part of the induction heating device to which the component support is fixed, particularly if said component support is prefixed to a dish-like cover prior to joining to the support device.

For a simpler construction of the heating device, it is advantageous to have only one component support for the supply part and on it are located both the power electronics and control electronics. In one embodiment, the components of the power electronics and in particular those which are not very susceptible to interference fields, are located on the side directed towards the induction coil. This is particularly advantageous if the component support is located as far as possible from the induction coil on the module. With particular advantage the control electronics parts, particularly the sensitive components, are located on the remote side of the component support.

The supply part or power electronics for the induction heating device are advantageously constructed with a single transistor inverter. The latter can form a parallel resonant circuit with the induction coil for limiting component costs. There can also be an optimum adaptation to the induction coil, particularly with respect to electrical parameters.

The power electronics advantageously have a heat sink, on which are in particular located an aforementioned transistor inverter or other power components. Said heat sink can also serve as one of the aforementioned spacers. As a result of its stable construction from aluminium, it can be installed in mechanically firmly connecting or force-transferring manner.

The fan device, which in particular cools the supply part or power electronics, can be positioned between the induction coil and the component support or the supply part, i.e., it is completely integrated into the induction device module. It is advantageously connected to the supply part and/or component support for controlling the power supply.

A cooling air circulation can be constructed in such a way that on a side remote from the induction coil, which in use is normally the underside, cooling air is introduced or sucked through one or more predetermined suction ports. These suction ports are close to the fan device and in particular directly below the same. The fan device initially blows cooling air against the supply part or power electronics or a heat sink provided for the same. Subsequently, the cooling air flow is moved past the other power electronics and also control electronics, after which it can flow out of the heating device. For this purpose it is advantageous to provide an opening in the central area of the support device through which the cooling air can flow. Particularly for installation below a cover, such as a glass ceramic hob plate, between the induction coil and the underside of the hob plate is provided an air gap of a few millimetres. Through said gap cooling air can escape to the outside and preferably a substantially radially outwardly propagating cooling air flow passing over the entire induction coil is produced. For this purpose, air conducting elements can be provided and in this way the induction coil can be cooled. It is not prejudicial here that the cooling air has already cooled other parts of the induction heating device and consequently has a high temperature. The temperature compatibility of conventional induction coils is well above that of electrical components, generally above 200° C.

Through the provision of the fan device directly on the heating device, which can also cool the induction coil, it is possible to obviate the need for other thermal insulation. Thus, the construction is simpler and assembly takes place more rapidly.

The heating device can have a temperature sensor in an available central area of the induction coil and it can detect the temperature of a hob plate or cover passing over the same. For this purpose the temperature sensor is advantageously so constructed that it engages with heat-transmitting contact on the underside both for clearly defined positioning and also for temperature measurement. In the case of cooling air circulation extending through the centre, the air is moved past the temperature sensor.

Advantageously, the finished induction heating device module only projects laterally slightly over the induction coil. This leads to a relatively compact construction of the overall module. This makes it possible to arrange an induction heating device of this type in a relatively confined, space-saving manner in a hob, together with other heating devices such as radiant heaters.

Spacing elements can be formed in the outer area and/or a central area on the induction coil support device. They project over the induction coil and are used for application to a hob plate passing over the same to ensure a clearly defined spacing.

An inventive hob has several heating devices, whereof at least one is an aforementioned induction heating device. The heating devices are fixed to the hob, in particular either to a support tray terminating the underside, or to a hob plate terminating the top side. In particular, in such a hob the inventive induction heating devices and conventional radiant heaters are combined.

The hob has an operating device, which is provided with operating elements and a control. Thus, operation-dependent control signals can be generated and are passed at least directly to an induction heating device or its control electronics. Moreover, there is a mains part for the hob and electric leads pass directly from the mains part to the power electronics of the supply part of the induction heating device. As a function of the control signals, the supply part assumes responsibility for supplying power to the induction coil. Thus, there is no need for other power electronics normally provided in a central manner for supplying several induction coils.

Instead of controlling a hob using, for example, contact switches, it is also possible to provide electromechanical power control devices, such as known from DE 198 33 983 A1. These control devices contain a cyclic, mechanical switch, which generates switching signals, or in the case of connected radiant heaters, directly supplies them with power. In the case of a corresponding adjustment, said electrical switching signals can also be supplied to the control electronics of an induction heating device. On the one hand it is possible to detect the set power level in permanent operation and then ensure a continuous power supply with a corresponding power level at the induction coil. On the other hand, control electronics can operate the induction coil cyclically in much the same way as a radiant heater, i.e. only for specific time periods, but with full power.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

Turning now to the figures, FIG. 1*a* shows an induction heating device 11 broken down into its essential parts. An induction coil 13 comprises several turns 14 of a coil wire 15 with an inner terminal 16*a* and an outer terminal 16*b*. A temperature sensor 18 with lead 19 is located in the central area.

The induction coil 13 is carried by or supported on a support device 20. Support device 20 advantageously is made from plastic and is substantially flat and plate-like. It has shaped-on spacers 22, whose function will be explained in greater detail hereinafter. As can best be seen in FIG. 4, the fixed elongated, flat ferrite cores 25 are placed in corresponding receptacle 24 on the underside. The support device 20 also has holes 27, through which can be passed downwards the terminals 16 of induction coil 13 and the terminals 19 of temperature sensor 18.

The supply part 30 contains the electronics and comprises a component support 31, e.g., a printed circuit board, located below support device 20. On the top surface of the component support 31 are the power electronics 33 and on its bottom surface are the control electronics 35. The power electronics 33, for example, incorporates a transistor 34 with heat sink 35. The further components of the power electronics 33 are those normally present in the power electronics of an induction heating device. The components of the control electronics 37 are also typical components, particularly ICs or smaller components.

Thus, the electrics that form the supply part and will be described in greater detail hereinafter. A fan device 39, advantageously an integrated fan such as for example a radial fan, is mounted or fastened to the supply part 30, particularly with a direct cooling action for heat sink 35 and therefore transistor 34.

From below, a cover 40 is fitted to the induction device 11 and comprises a substantially flat cover plate 41 from which projects a substantially circumferential lateral edge 42. Cover 40 is advantageously made from plastic.

Below the support device 20 and in particular below induction coil 13 and ferrite cores 25, can be placed in the assembled state an aluminium plate 26 for shielding the supply part below the same.

Figure 1B:
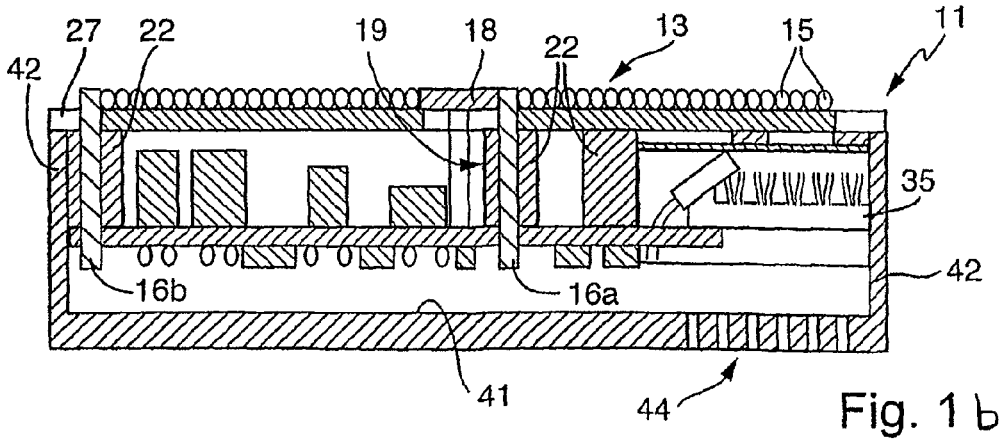

FIG. 1*b* shows the assembled induction heating device 11. The lateral edge 42 of the cover 40 extends essentially all round up to support device 20 or its outer edge so as in this way to form a closed module. The induction coil 13 engages directly on support device 20. To its spacers 22 are applied supply part 30 or component support 31, particularly by screwing down or fastening. The terminals 16 of induction coil 13 are fixed to corresponding terminals of supply part 30, for example the coil wire 15 is firmly directly soldered to the contact banks. The fan device 39 is positioned laterally alongside heat sink 35 (see also FIG. 5). A cooling air intake takes place through the cooling air openings 44 in the lower part of cover 40 or cover plate 41. Alternatively, they can be provided on lateral edge 42, as a function of the nature and arrangement of fan device 39. The cooling air circulation passes through the cooling air openings 44 and heat sink 35, from where the cooling air flows over the remaining surface of component support 31 or power electronics 33. The air then passes through the central hole 27 and past the temperature sensor 18 in the upwards direction and spreads radially outwards between the underside of a hob plate above the same and the top of induction coil 13. In this way all the swept over parts are cooled.

Figure 2A:
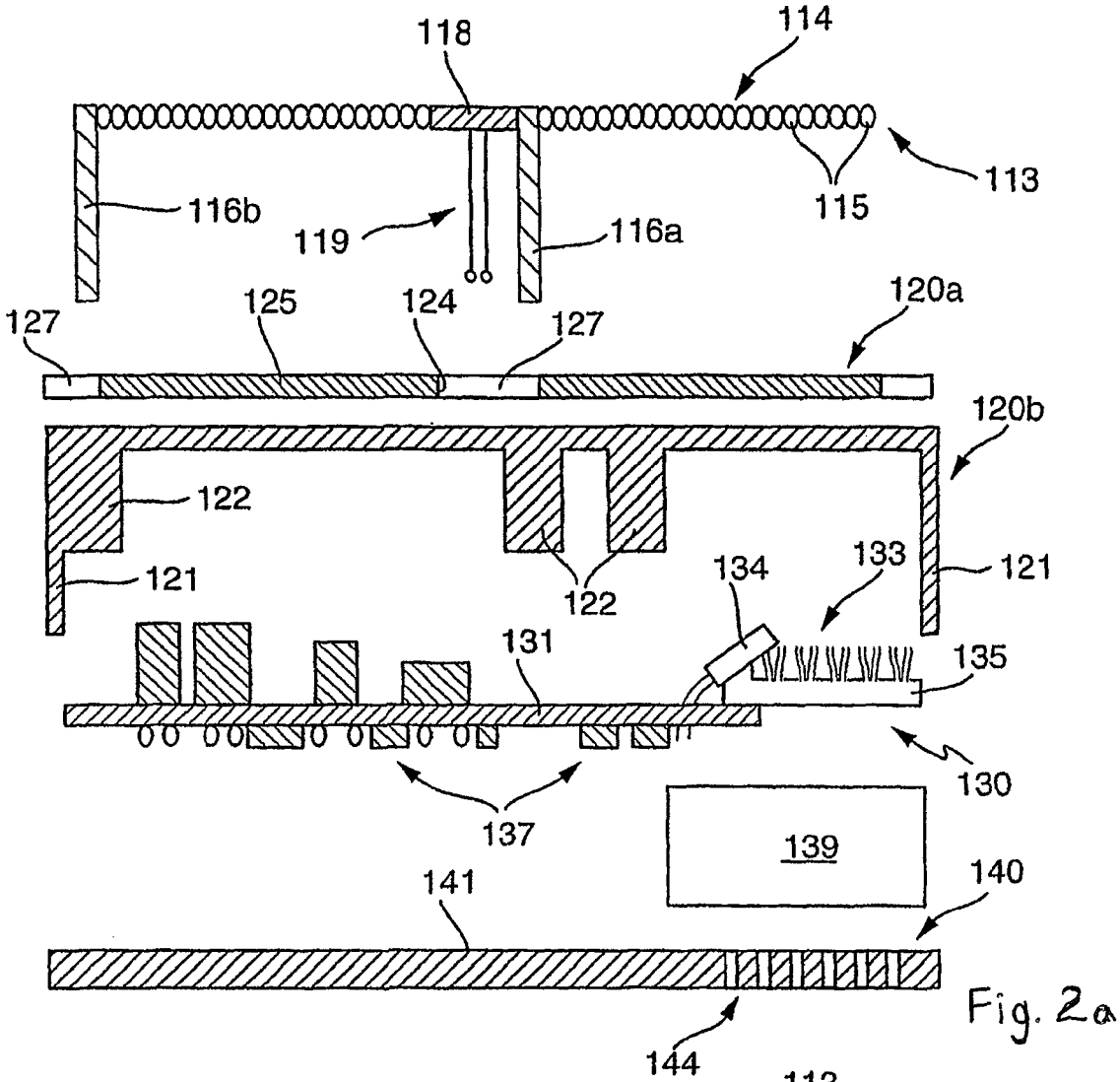
Figure 2B:
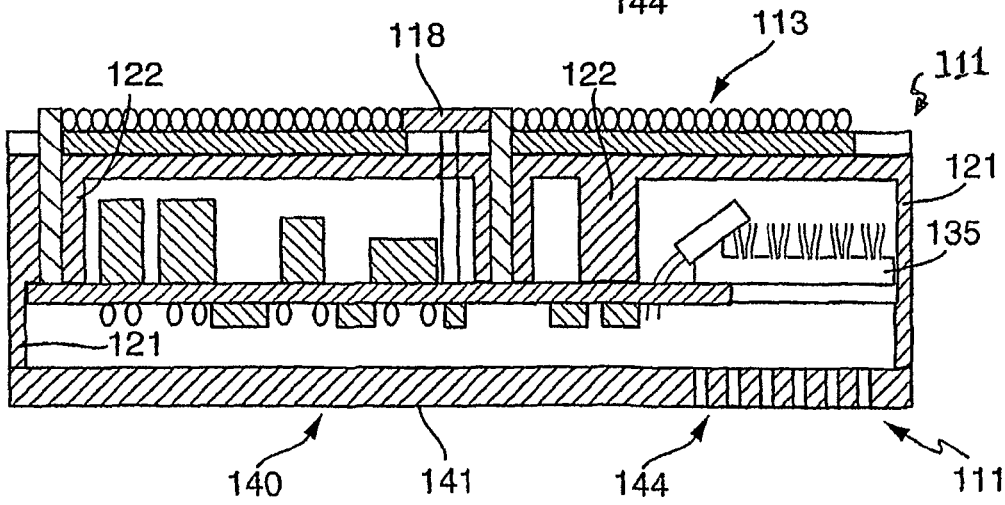

FIGS. 2*a* and 2*b* show a variant of the same induction coil 113 as in FIG. 1. In FIG. 2*a*, the induction coil 113 engages on a first support device 120*a*, which is merely a flat plate with corresponding receptacles 124*a* for ferrite cores 125. The second part of the support device is base part 120*b*, on which are formed both spacers 122 and lateral edges 121, which advantageously are constructed in circumferential manner terminating the induction heating device 111.

Supply part 130 and fan device 139 correspond to the same parts in FIG. 1. The module is downwardly terminated by a cover 140, which merely comprises a flat cover part 141, i.e. has no lateral edges or the like.

In FIG. 2*b*, it is clear from the assembled induction heating device 111, how induction coil 113 and supply part 130 engage on a two-part support device with upper support 120*a* and lower support 120*b*. The supply part 130 or component support 131 engage on and are fixed to spacers 122. Thus, compared with FIG. 1, the support device is in two parts and itself has the lateral edge 121. However, the cover has no lateral edge.

Figure 3A:
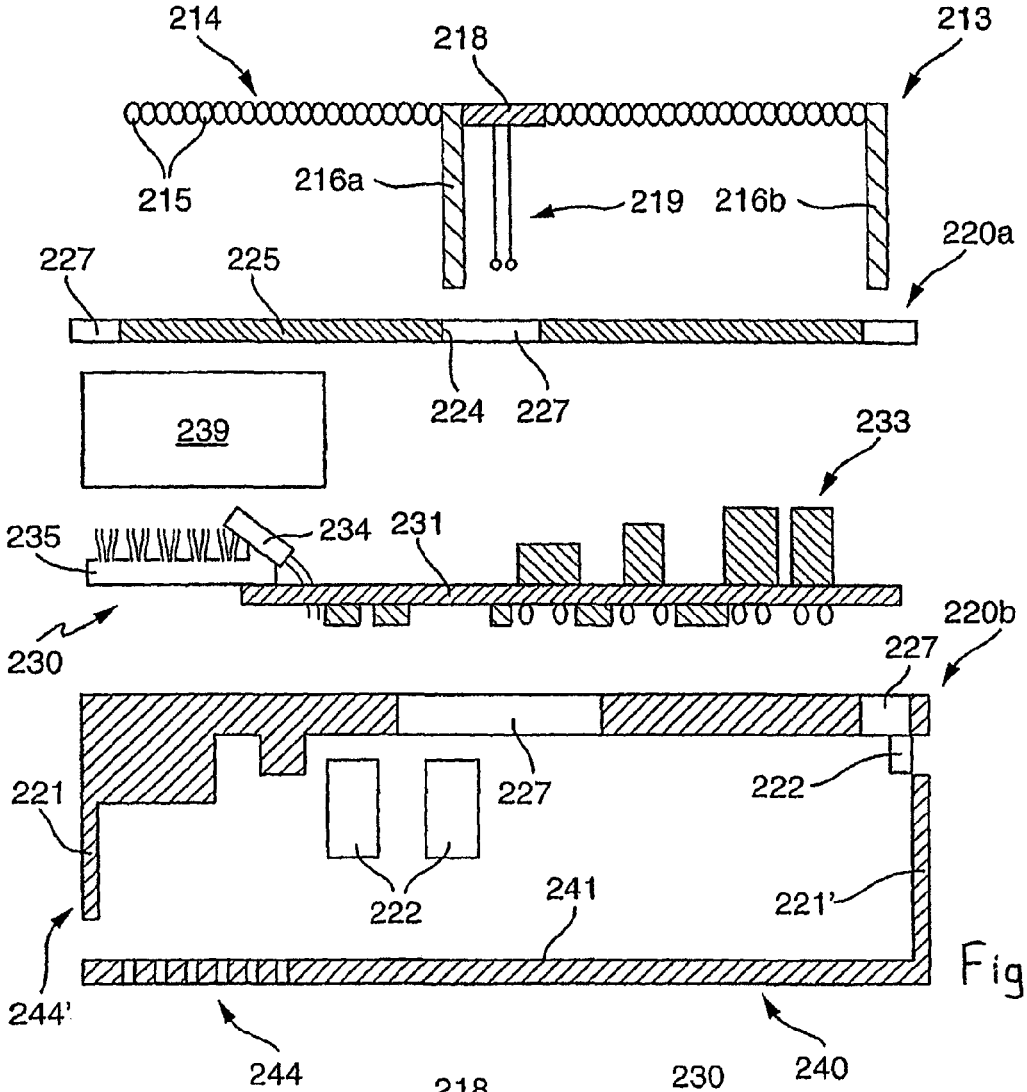
Figure 3B:
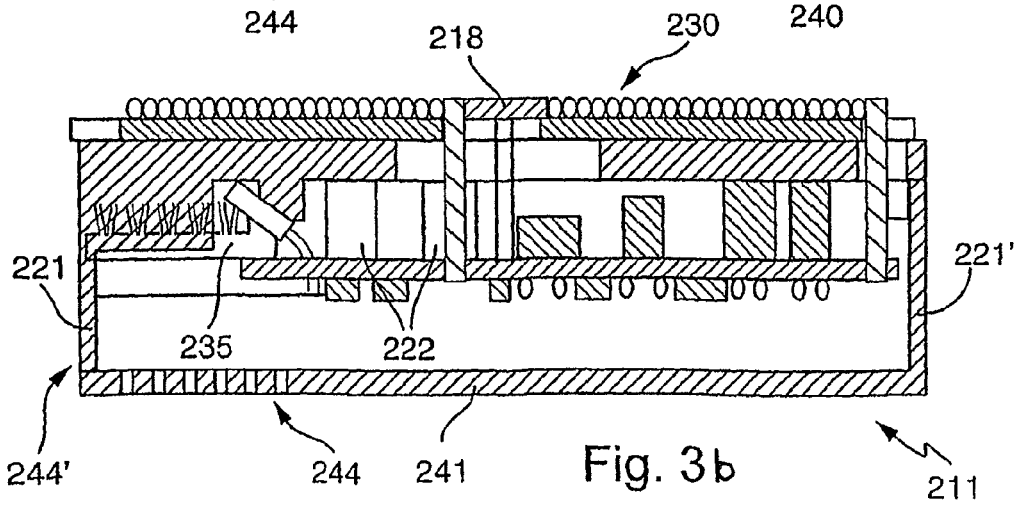

As in FIGS. 1 and 2, in FIG. 3 (with FIG. 3*a* illustrating an exploded parts view and FIG. 3*b* illustrating an assembled parts view) once again the same induction coil 213, as well as the upper part of support 220*a* are provided. Also supply part 230 and fan device 239 correspond to those of the previous drawings. The support device is also provided here with a lower support 220*b*, i.e., with a two-part support device. However, the spacers 222 are constructed as separate components and are also separately installed. The lower support 220*b* has the projecting lateral edge 221. In the downwards direction cover 240 corresponds to that of FIG. 2, i.e., it is merely a flat cover plate 241.

From the assembled state of the induction heating device 211 (FIG. 3*b*), it is clear that apart from the spacers 222 not shaped onto the support device 220, it corresponds to the variant of FIG. 2.

Figure 4:
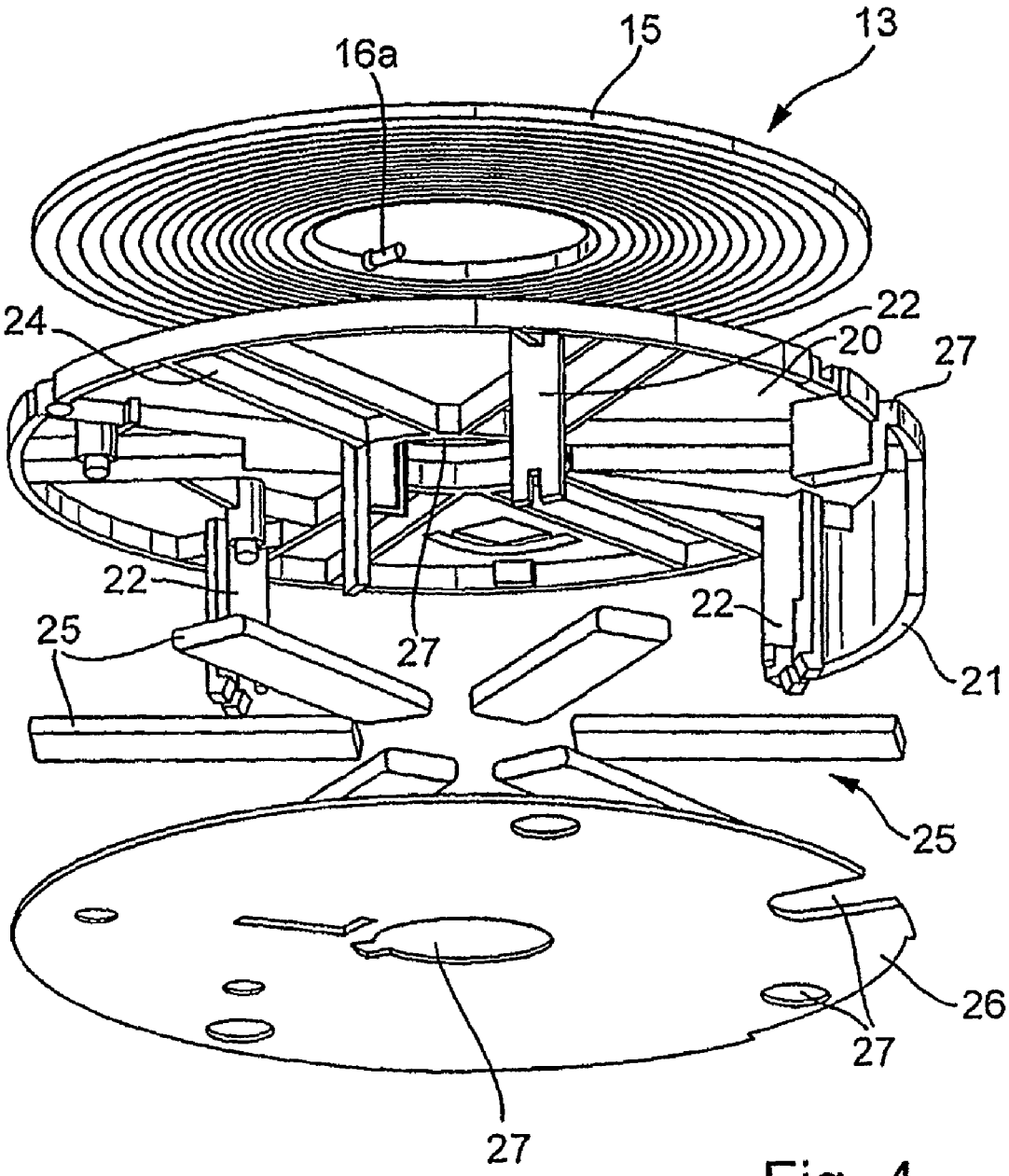
FIG. 4 illustrates a more detailed view of an induction heating device according to FIG. 1 with a one-part support device.

FIG. 4 shows in greater detail the construction of the induction heating device 11 of FIG. 1. The round induction coil 13 is, or will be, applied to the support device 20. Several spacers 22 are shaped onto the underside of the substantially flat support device 20. In addition, spoke-like receptacles 24 are formed in which can be placed and secured the flat ferrite cores 25. Above the same is again placed the correspondingly shaped aluminium plate 26, which at the same locations has holes 27 and also the support device 20, particularly for the passage of connections. The spacers 22 also project through the aluminium plate 26. It can be seen that a short lateral edge portion 21 projects from support device 20 at a single location and further details thereof will be given hereinafter.

Figure 5:
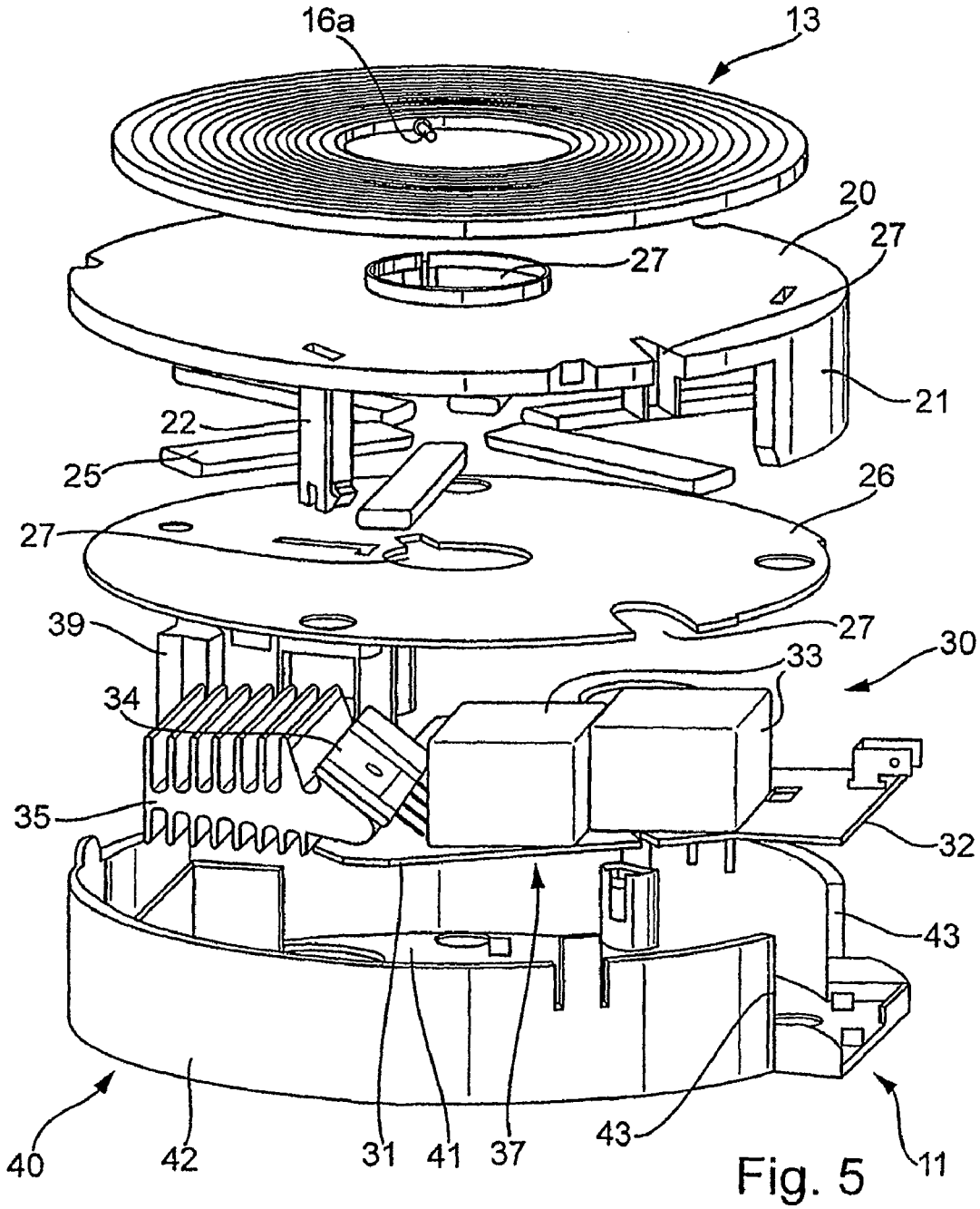
FIG. 5 illustrates an embodiment of the assembly of an induction coil according to FIG. 4 to which both a component support and a dish-like cover are fastened from below.

From a somewhat different perspective, FIG. 5 illustrates the overall assembly of the induction heating device 11. The supply part 30 is shown in addition to the parts already described relative to FIG. 4. It has a component support 31 on which is located the power electronics 33, together with the transistor 34 and heat sink 35. Fan 39 is directly connected to the heat sink 35 and blows cooling air directly onto it. It must be borne in mind that component support 31 stops just behind transistor 34, so that heat sink 35 projects over it.

To the right component support 31 passes into a connecting section 32, which has at least two plug-in termination lugs, which are in particular provided for a power mains connection, i.e., form the power connection or connection from the outside power to power electronics 33. A control connection to control electronics 37 is not shown, but can easily take place by means of, for example, corresponding plug-in termination lugs or a flat plug-in connection.

Beneath the component support 31 is provided the cover 40, which is essentially dish-like in shape. However, in the vicinity of connection section 32 a recess 43 is provided in lateral edge 42. The lower cover plate 41 extends sufficiently far that it also supports or covers from the bottom connection section 32. Thus, recess 43 in lateral edge 42 enables the connection section 32 to project from the otherwise closed induction heating device 11. In order to close recess 43 again, the small piece of lateral edge 21 is provided on support device 20.

Figure 6:
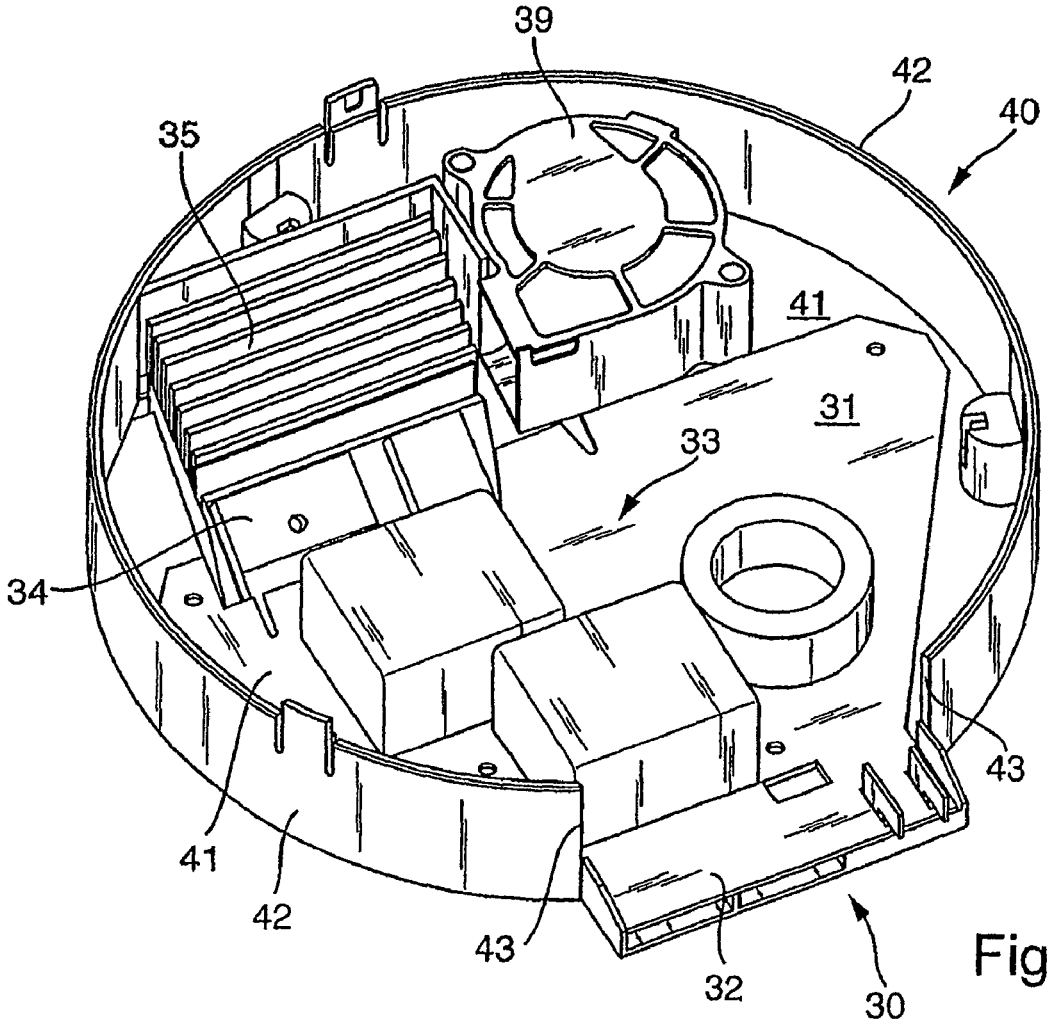
FIG. 6 illustrates an angled view from above of the arrangement of the component support of FIG. 5 positioned in the cover.

FIG. 6 is an angled plan view showing how supply part 30 is inserted in cover 40. FIG. 6 shows that fan 39 is close to the heat sink 35. FIG. 6 also shows how the connection section 32 projects outwards through recess 43 and is therefore readily accessible. Component support 31 is covered in roughly two thirds of the surface of cover plate 41 and has a substantially triangular construction and does not entirely follow the circular path of cover plate 41. The visible control electronics 37 (not shown in FIG. 6) are located on the underside of component support 31.

Figure 7:
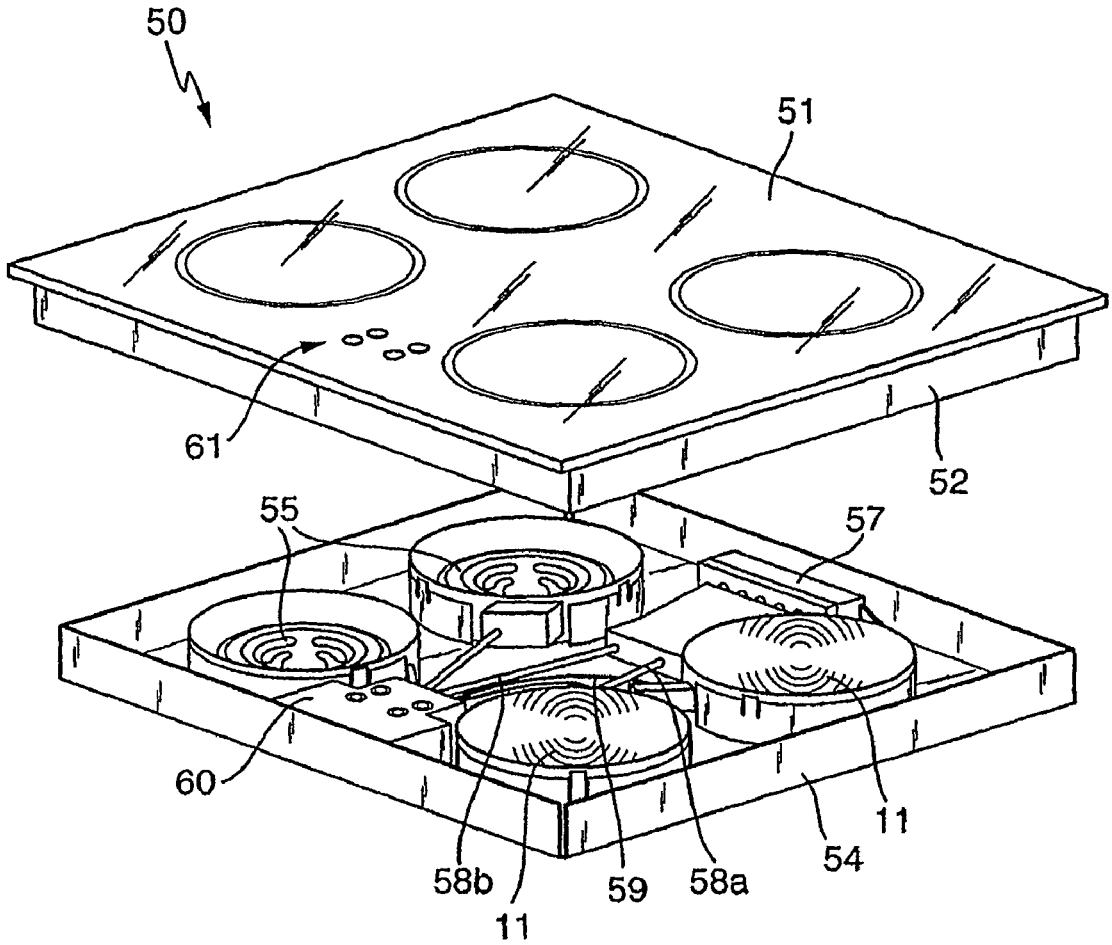
FIG. 7 illustrates a hob with heating devices located in a receiving tray and a glass ceramic hob plate above the same.

FIG. 7 shows the complete hob 50, which comprises a hob plate 51, for example of glass ceramic material, which is provided with a circumferential frame 52, which is made, for example, of metal. In an metallic or plastic receiving tray 54 are located various heating devices and in the present embodiment the two left-hand heating devices are radiant heaters 55 and the two right-hand ones are induction heating devices 11 of varying size according to the invention.

In the rear, e.g., central rear of the receiving tray, is provided a mains connection 57 enabling the hob 50 to be connected for example in the conventional manner to a power source in a home. From the mains connection 57 emanate connecting cables 58*a* directly to the two induction heating devices 11 or their connection sections 32. Connecting cables 58*b* also pass to a control device 60, which assumes responsibility for the direct power supply of radiant heaters 55. For this purpose control 60 may have contact switches for an operator and these are indicated by corresponding markings 61 on the top of hob plate 51. Thus, it is possible to input control signals or operating instructions, particularly for the selection of a hotplate or heating device, as well as for adjusting the power level. With regards to radiant heaters 55, the control 60 effects this internally, for example using power relays, which connect the selected radiant heaters 55 by connecting cables 58*b* to the mains connection 57 and therefore supply full power, particularly in cyclic operation.

For the induction heating devices 11, control lines 59 lead from the control 60 and supply the corresponding instructions to the control electronics 37 of induction heating devices 11. As power electronics 33 are directly connected by connecting cables 58*a* to mains connection 57, in this way control electronics 37 can directly supply or control the power to the induction heating device 11.

As can be seen in FIG. 7, the inventive induction heating devices 11 in the inventive hob 50 are constructed in the same size as conventional heating devices, such as for example radiant heaters 55, with regards to the external dimensions. Due to the fact that they are constructed as autonomous modules with their own control and power electronics, the hob 50 requires no central power electronics or power supply. A mains connection 57 is necessarily provided for each hob. The inventive induction heating devices 11 can also be freely varied with respect to their arrangement. It is merely necessary to lay connecting cables 58 and control lines 59 in hob 50, which gives rise to no particular problems. The induction heating devices 11 are advantageously given similar dimensions to the radiant heaters 55, particularly with regards to their height. In certain circumstances it is even possible to use the same fastening means with spring clips or the like, which permits a more flexible arrangement of induction heating devices in a so-called mixed hob.

The invention claimed is:

1. A cooking appliance comprising:

a support tray, configured to receive and affix a plurality of modular heating devices, said modular heating devices comprising at least two induction heating modules, wherein each induction heating module is physically distinct from another and wherein each induction heating module comprises:

a support device comprising having a circular shape;

a single induction coil placed on top of said support device;

a supply part comprising power electronics and control electronics, said supply part receiving household voltage and converting said household voltage to said induction coil, said supply part held in position by said support device;

a fan device for cooling said power electronics wherein said fan is located within said induction heating module positioned underneath said induction coil, wherein said fan device is fixed to said support device;

electrical power connections for receiving said household voltage, said electrical power connections conveying said household voltage to said supply part;

a cover positioned below induction coil and said support device wherein said cover is of a shape that largely encloses said supply part and said fan; and electrical control connections for receiving control signals, said electrical control connections conveying said control signals to said supply part, said induction heating module configured to be installed within said cooking appliance as an assembled unit with said electrical power connections engaged with household voltage connections of said cooking appliance, and with said electrical control connections being connected to control connections of said cooking appliance.

2. The cooking appliance according to claim 1, wherein said support device is flat and disk-like, said support device having a greater diameter than said induction coil.

3. The cooking appliance according to claim 1, wherein said supply part comprises a component support board positioned substantially parallel to said induction coil, wherein said power electronics and said control electronics are attached to said component support board.

4. The cooking appliance according to claim 3, wherein said fan device is attached to said component support board and has spacers for engaging said support device.

5. The cooking appliance according to claim 3, wherein said component support board is in contact with a plurality of spacers of said support device.

6. The cooking appliance according to claim 5 further comprising:

a cover, wherein said cover surrounds said component support board, said cover further having a substantially tray-like construction and forming a reception area for covering said surface of said component support board, said cover also extending on sides up to said support device in such a way that said finished induction heating device is a substantially enclosed module.

7. The cooking appliance according to claim 6, wherein said cover is affixed only to said support device.

8. The cooking appliance according to claim 6, wherein said cover is only fixed via said spacers to the component support board.

9. The cooking appliance according to claim 1, wherein said support device comprises a projecting, substantially circumferential lateral edge in an outer area forming a dish-like receptacle.

10. The cooking appliance according to claim 9, wherein said supply part comprises a component support board to which said power electronics, said control electronics and said fan device are attached, wherein further, said component support board is located in said receptacle of said support device.

11. The cooking appliance according to claim 10, wherein said dish-like receptacle is closed by a cover contacting said projecting lateral edge of said support device.

12. The cooking appliance according to claim 11, wherein said cover is flat with a circular shape and is held in position by said lateral edge of said support device.

13. The cooking appliance according to claim 12, wherein in a central area of said support device is provided at least one spacer for positioning said supply part or said component support board thereon.

14. The cooking appliance according to claim 13, wherein said spacer is integrally formed as one piece with said support device.

15. The cooking appliance according to claim 9, wherein said support device comprises at least two support parts, a first support part being said flat support for said induction coil and a second support part being connected to said supply part.

16. The cooking appliance according to claim 15, wherein said two parts of said support device are detachably interconnected and said first support part is substantially disk-like.

17. The cooking appliance according to claim 16, wherein said second support part has a circumferential lateral edge for forming a dish-like receptacle for said supply part or said component support board, said lateral edge projecting from a disk-like central part.

18. The cooking appliance according to claim 17, wherein said supply part or said component support board are in contact with to said second support part.

19. The cooking appliance according to claim 18, wherein said second support part has spacers for engagement on said component support, which form an integral unit with said second support part.

20. The cooking appliance according to claim 1, wherein said supply part has a single component support board for said power electronics and said control electronics.

21. The cooking appliance according to claim 20, wherein said power electronics components are located on a side of said component support board being directed towards said induction coil.

22. The cooking appliance according to claim 1, wherein said power electronics contained therein have a single transistor inverter and form a parallel resonant circuit with said induction coil.

23. The cooking appliance according to claim 1, wherein said fan device is positioned between said induction coil and said supply part.

24. The cooking appliance according to claim 23, wherein said fan device is provided with electrical connections connected to said supply part.

25. The cooking appliance according to claim 1, wherein there is one or more openings allowing passage of cooling air onto the induction heating device in the vicinity of said fan device, wherein further the fan draws in air and blows it against at least one of said power electronics or a heat sink.

26. The cooking appliance according to claim 25, wherein said cooling air flows by said power electronics, said control electronics, through a central opening provided in said support device and then through a free central area of said induction coil thereby exiting the induction heating device.

27. The cooking appliance according to claim 1, wherein said control signals are for adjusting a power level of said induction coil.

28. The cooking appliance according to claim 1 wherein said induction heating module has a lateral extension projecting only slightly beyond that of said induction coil.

* * * * *